United States Patent [19]

Reese

[11] Patent Number: 4,509,702

[45] Date of Patent: Apr. 9, 1985

[54] APPARATUS FOR PACKAGING A PLURALITY OF FIBERS OR STRANDS

[75] Inventor: Walter J. Reese, North Huntington, Pa.

[73] Assignee: PPG Industries, Inc., Pittsburgh, Pa.

[21] Appl. No.: 461,331

[22] Filed: Jan. 27, 1983

[51] Int. Cl.[3] ..... B65H 54/02

[52] U.S. Cl. ..... 242/18 G; 242/42; 242/43 R; 242/157 R; 242/159; 242/166

[58] Field of Search ..... 242/18 G, 18 R, 42, 242/159, 43 R, 158.3, 166, 157 R

[56] References Cited

U.S. PATENT DOCUMENTS

| | | | |
|---|---|---|---|
| 3,365,145 | 1/1968 | Klink et al. | 242/166 |
| 3,367,587 | 2/1968 | Klink et al. | 242/18 G |
| 3,371,877 | 3/1968 | Klink et al. | 242/18 G |
| 3,498,550 | 3/1970 | Klink et al. | 242/18 G |
| 3,547,361 | 12/1970 | Klink | 242/18 G |
| 3,845,912 | 11/1974 | Eichmanns et al. | 242/18 R |
| 3,850,294 | 11/1974 | Philipps et al. | 242/159 X |
| 3,998,404 | 12/1976 | Reese | 242/158.3 |
| 4,130,248 | 12/1978 | Hendrix et al. | 242/42 X |
| 4,167,252 | 9/1979 | Klink et al. | 242/18 G |
| 4,244,533 | 1/1981 | Reese | 242/18 G X |
| 4,322,041 | 3/1982 | Schuller et al. | 242/42 |

*Primary Examiner*—Stanley N. Gilreath
*Attorney, Agent, or Firm*—Kenneth J. Stachel

[57] ABSTRACT

An apparatus, method and package are provided for producing and winding strands to achieve good split efficiency on removal of the plurality of strands from the package for further processing and to produce a package of wound strands having good edges.

The apparatus has a fiber forming means, an applicating means for applying chemical treating compositions to the fibers, gathering means to gather the fibers into a plurality of strands, a rotatable winder to attenuate and wind the strands, a slotted traversing guide, a reciprocating means, and contact means at each end of the reciprocating stroke of the traversing guide. The slotted traversing guide has more than one slot where the terminal portions of the slots have curved ends to retain a strand and are located directly behind the terminal portion of the preceeding slot. The slotted traversing guide deposits the strands on the rotating winder and as the traversing guide approaches the point at which it reverses to traverse in the opposite direction parallel to the axis of rotation of the winder the strands above or below the traversing guide contact a contacting means to restrain the traversing movement of the contacted segment of the strands to apply tension to the strands being wound onto the winder. This additional tension assists in producing squarer edged packages having good split efficiency.

12 Claims, 5 Drawing Figures

APPARATUS FOR PACKAGING A PLURALITY OF FIBERS OR STRANDS

BACKGROUND OF THE INVENTION

This invention relates to an apparatus and method for producing packages of fibers, strands and the like and the packages so produced.

More particularly, this invention is directed to an apparatus and method for producing packages and said packages having a plurality of continuous strands so that the package has neat edges and facilitates the removal of the distinct strands from the package.

In the manufacture of continuous fibers or strands, the packaging of these materials to facilitate the removal of the continuous materials for use in sundry processes is an important aspect in their manufacture. Generally, when continuous fibers or strands are produced they are wound onto a package, and the package of fibers or strands is used subsequently to produce various products. The fibers or strands must be easily removable from their packages to have an efficient operation in producing manufactured products, and this is particularly important for multistrand packages. In addition, a package of continuous fibers or strands containing a plurality of distinct fibers or distinct strands should have neat edges and not feather-edges at the ends of the package. A feather-edge package is detrimental to removing the distinct fibers or strands for further processing, since this type of package contains groups of fibers or strands in which one fiber or strand of an array is wrapped on a substantially larger or smaller diameter of the package than another fiber or strand in the same array. When this type of package is unwound, different lengths of the fibers or strands would be obtained. This difference in length is commonly referred to as catenaries. The catenaries can cause looping and snarling in the processing of the continuous fibers or strands from the package into manufactured products. Also the feather-edge type package presents a greater risk for damage occurring to the continuous fibers and/or strands at the edge of the package during shipment of the packages. Any damage to the continuous fibers or strands at the ends of the packages could result in broken fibers or strands engendering difficulties, when the fibers are removed from the package. The feather-edge package usually has a larger diameter in the center of the package than the diameter at the ends of the package. An extreme uneveness in the diameter of the package requires the controlled use of additional devices in winding such a package so that the guide used to traverse the continuous fibers or strands onto the package continuously moves away from the building package. This movement prohibits the building package from touching the traversing guide.

In the manufacture of continuous glass fibers and/or strands, a roving can be produced, which is a cylindrically shaped package of one or more bundles of glass fibers wound in parallel. Traditionally, these roving packages have been produced by mounting a plurality of packages of glass fiber strands that were produced in forming the glass fiber strand on a creel or support and gathering the plurality of strands in a parallel array and winding these strands onto a cylindrical package.

Recently it has become a standard practice in the industry to produce a cylindrically shaped package of bundles of glass fibers during the formation of the glass fibers. This directly wound package has at least flat surfaces and at least nearly square edges on both ends of the packages. Such a directly wound cylindrical package of strand has the benefit of being made on a large scale in one operation, i.e. starting with the glass making raw materials and finishing with a cylindrical package sometimes referred to as a roving package that is ready for packaging and shipment.

Reportedly, a direct drawn roving package has been developed to take full advantage of even tensioning of glass fibers that are to be used in reinforcing polymeric materials. This is reported at pages 261 through 263 in "The Manufacturing Technology of Continuous Glass Fibers", by K. L. Lowenstein, Elsevior Scientific Publishing Company, Amsterdam, The Netherlands, 1973. In the production of roving packages, the lay of the strands in the successive layers making up the package is important to achieve the desired dimensions of the package. Also, the lay of the strands is important in roving packages in removing the strands from a roving package to use the strands for various applications, such as the formation of continuous strand mat, or the chopping of the strands to produce chopped glass fibers for reinforcement of polymeric and/or elastomeric materials, and/or the production of chopped strand mats. The ability to obtain the same number of distinct strands out of the wound roving package as were placed into the wound roving package during processing is an important parameter to the efficiency of further process operations. This ability is referred to as the splitting efficiency, which is defined in the book, "The Manufacturing Technology of Continuous Glass Fibers," at pages 181 and 182 as the number of strands formed expressed as a percentage of the number that should have been formed. The determination involves the counting of the number of strands in a sample of known weight. The splitting efficiency can be found by the formula: $NLT/10^4$ ws %. Where N is the number of strands formed in a sample of a specific weight, L is the chopping length, and T is the tex of the plurality of strands, and w is the weight, and s is the intended split of the strands.

It would be beneficial to both the producer and user of glass fiber strand to produce glass fiber strands in a roving package produced directly in drawing the glass fibers, where the direct drawn roving packages have a good shape and a good split. To this end, the art has made numerous attempts to commercially produce a multiple strand, directly drawn roving product, but currently such a product is not readily available in the marketplace.

An early attempt discussed in U.S. Pat. No. 3,365,145 involves the use of a traversing device with a sensing means along with projections from the traversing device having pins which contact the edge of the layers of strands being wound so that the edge of the layer of a plurality of strands is forced into a straight edged package.

Another approach disclosed in U.S. Pat. No. 3,371,877 (Klink et al.) involves the use of a traversing device having a guide which is a comb, wherein in each slot of the comb a single strand is located for placement of the strands in side-by-side array in the layer on the wound package. Above the comb on either end of the traverse are studs upon which the strand impinges at the end of each traverse to provide edge control in building up the successfully layered package. As is shown in the patent at FIG. 6. this edge control still allows the strands coming from the comb to remain in side-by-side relationship. Underneath the comb receiving the strands coming from the comb is a T-shaped slotted device acting as a sensor and guide member as the strands are wound in side-by-side relation onto the package.

A more recent approach is disclosed in U.S. Pat. No. 4,322,041 (Schullar et al.) which discloses the use of a traverse guide member which is used in very close proximity to the package of continuous multiple strand material being wound. The strand traverse guide is a vertical concave device with a V-shaped slot. The plurality of strands ride as separated strands on one or the other of the sloping sides of the V-shaped slot depending upon which direction the strand traversing guide is being traversed. The strand traversing guide also has a surface portion beneath the V-shape slot, which contacts all the strands and is in intimate contact with the rotating winder upon which the package is wound. This allows the strands to be wound on to the package almost immediately after contacting this surface portion of the guide.

It is an object of the present invention to provide an apparatus and method for producing a wound cylindrical package of a plurality of distinct strands, where the package has a neat appearance to reduce the risk of damage to the strands in the package during shipping, and, where the package has a good split efficiency in removing the distinct strands from the package for further processing.

It is a further object of the present invention to provide a package of wound strands having a plurality of distinct strands wound in successive layers, where the distinct strands are wound to facilitate a neat package to reduce the risk of damage to any of the strands in the package during shipment and to allow for good split efficiency in removing the plurality of distinct strands from the package for further processing.

SUMMARY OF THE INVENTION

In accordance with the instant invention, a plurality of fibers or a plurality of strands can be produced and collected by an apparatus having: a means for forming a plurality of the continuous fibers from a supply; an applicating means for applying an aqueous or organic chemical composition to the fibers; a means for gathering the plurality of fibers into more than one bundle of continuous fibers; a rotatable winder to collect the more than one bundle of continuous fibers; a slotted traversing guide to engage the bundles of fibers and to guide them onto the rotating winder to produce successive layers of bundles of fibers hereinafter referred to as strands; a reciprocating means mounted to the traversing guide so that the traversing guide is approximately horizontally positioned to reciprocate the traversing guide with the strands to form the layers of strands on the rotating winder; a means for starting and stopping the slotted traversing guide, and contacting means to contact the strands near the end of each layer to increase the tension on the strands by having the strands bend around the contacting means, when the slotted traversing guide passes by the contacting means.

The means for forming the plurality of continuous fibers can be any means used for forming fibers; for example, in forming glass fibers the means can produce streams of glass flowing from a supply of heat softened, fiberizable glass batch material and the applicating means applies a chemical material to the surface of the fibers. The means for gathering the fibers into the strands can be any means to bring more than one fiber together to form a strand and such means is usually located a sufficient distance from the means for forming the fibers to allow the fibers to cool to a temperature at which they can have the chemical composition applied to them from the applicating means. The rotating winder that rotates from any conventional drive means collects the continuous fibers and attenuates the continuous fibers from the supply of heat softened material and supports a successively layered, essentially cylindrical package of the continuous fibers. For example, in forming glass fibers the rotatable winder attenuates the continuous glass fibers from the supply of heat softened glass batch material that issues the streams of flowing glass.

The slotted traversing guide can be of any shape that is conducive to having two or more slots cut into it. Nonexclusive examples of the shape of the traversing guide includes flat bodied or nonflat bodied triangular; rectangular; polygonal, such as pentagonal and hexagonal; circular, eliptical and the like. The slots are to be in alignment so that the terminal portion of the slots are one behind the other in a linear configuration, and the beginning of the slots are at or near the periphery of the guide. The slots provided in linear configuration are adapted to engage strand placed in the slots and to retain the strand during the reciprocating traversing movement of the traversing guide. The number of slots of two or more in the traversing guide are provided to correspond to the number of strands being run to provide a given multiple strand product. The distance between the terminal portions of the slots should be sufficient to engender a separation between the strands, one behind the other, until the strands contact the rotating winder.

The reciprocating means traverses the traversing guide linearly and parallel to the axis of rotation of the rotatable winder to distribute the strands in successive layers on the rotating winder to form the essentially cylindrical package of successive layers of strands. The traversing guide is mountable on the reciprocating guide in an approximately horizontal position, where the degree of variation from the horizontal position can be up to around 45° in an upward or downward direction.

The traversing guide is capable of starting reciprocation and stopping reciprocation because of the necessity to place one strands per slot to start the winding of a multiple strand package. The splitting occurs when the traversing guide is stationery. Therefore, to start one package of multiple strands, the traversing guide must be stationary to place the strands into the slots of the traversing guide in conjunction with placing the plurality of strands on the winder. The traversing guide can be started and stopped simultaneously or sequentially with the rotation of the winder. The traversing guide is started and stopped by the use of an engaging means like a separate motor for the reciprocating means, or by a clutch means present to disengage the traversing guide from the reciprocating means or the reciprocating means from its drive means.

The movable contacting means is located to contact the strands as the traversing guide approaches the end of each reciprocating stroke to increase the tension on the plurality of strands. The contacting means are supported to contact the plurality of strands above or below the traversing guide as the traversing guide moves past the contacting means near the end of the reciprocating stroke of the traversing guide. This tension assists in developing a nearly square edge at each end of the successive layers of strands in the package.

Another aspect of the present invention is a method for collecting a plurality of continuous filaments into a wound package having successive layers on a rotating winder. The method involves supplying a plurality of continuous fibers and applying to the fibers water and/or a chemical composition and gathering the continuous fibers into a plurality of continuous strands. The chemical composition applied to the continuous fibers can be water or an organic liquid as a carrier or can contain emulsions, solutions and/or dispersions of polymeric film forming materials, coupling agents, lubricants and the like. Each continuous strand is placed into a slot in a stationary slotted traversing guide, where the terminal portion of each succeeding slot is positioned linearly behind the preceeding slot. In conjunction with or before or after placing the strands in the traversing guide, the plurality of strands is placed on the winder. The strands from the traversing guide are wound onto a rotating winder as the traversing guide is reciprocated parallel to the axis of rotation of the winder to deposit the strands onto the rotating winder in successive layers. As the traversing guide traverses toward the end of each layer the strands are contacted by the contacting means to place additional tension on the strands to produce a nearly square edge to the ends of the layers on the winder. When the successive layers are built up to form a package, the winder and traversing guide are stopped and the package is removed from the winder.

A further aspect of the present invention is a wound package having successive layers of a plurality of continuous strands produced by the aforedescribed method. The wound package has a moisture content in the range of up to around 15 percent by weight. In each successive layer at various locations in the layer, the plurality of continuous strands may be in crossing relation to each other, while at other locations in the layer the continuous strands may be in noncrossing side-by-side relation to each other. The nearly cylindrical package of wound continuous strands has neat square edges and the split efficiency upon removal of the plurality of strands from the package is greater than 75 percent and somewhat less than 100 percent.

BRIEF DESCRIPTION OF THE DRAWINGS

The apparatus, method and package of the present invention will be more fully described in respect to the attached drawings in which.

DETAILED DESCRIPTION OF THE DRAWINGS

While the apparatus, method and package of the present invention are particularly suitable for forming fibers of heat-softened, fiberizable material such as glass for producing glass fibers and producing multi-strand roving of the glass fibers, in the broadest aspect of the present invention, the apparatus and method may be utilized for producing packages and particularly roving packages of filamentary materials other than glass. The following disclosure will be directed to the formation and winding of a plurality of glass fiber strands having continuous glass fibers, although such disclosure is not limiting to the type of strands that can be formed and wound by the apparatus of the present invention using the method of the present invention to produce the package of the present invention.

Figure 1:
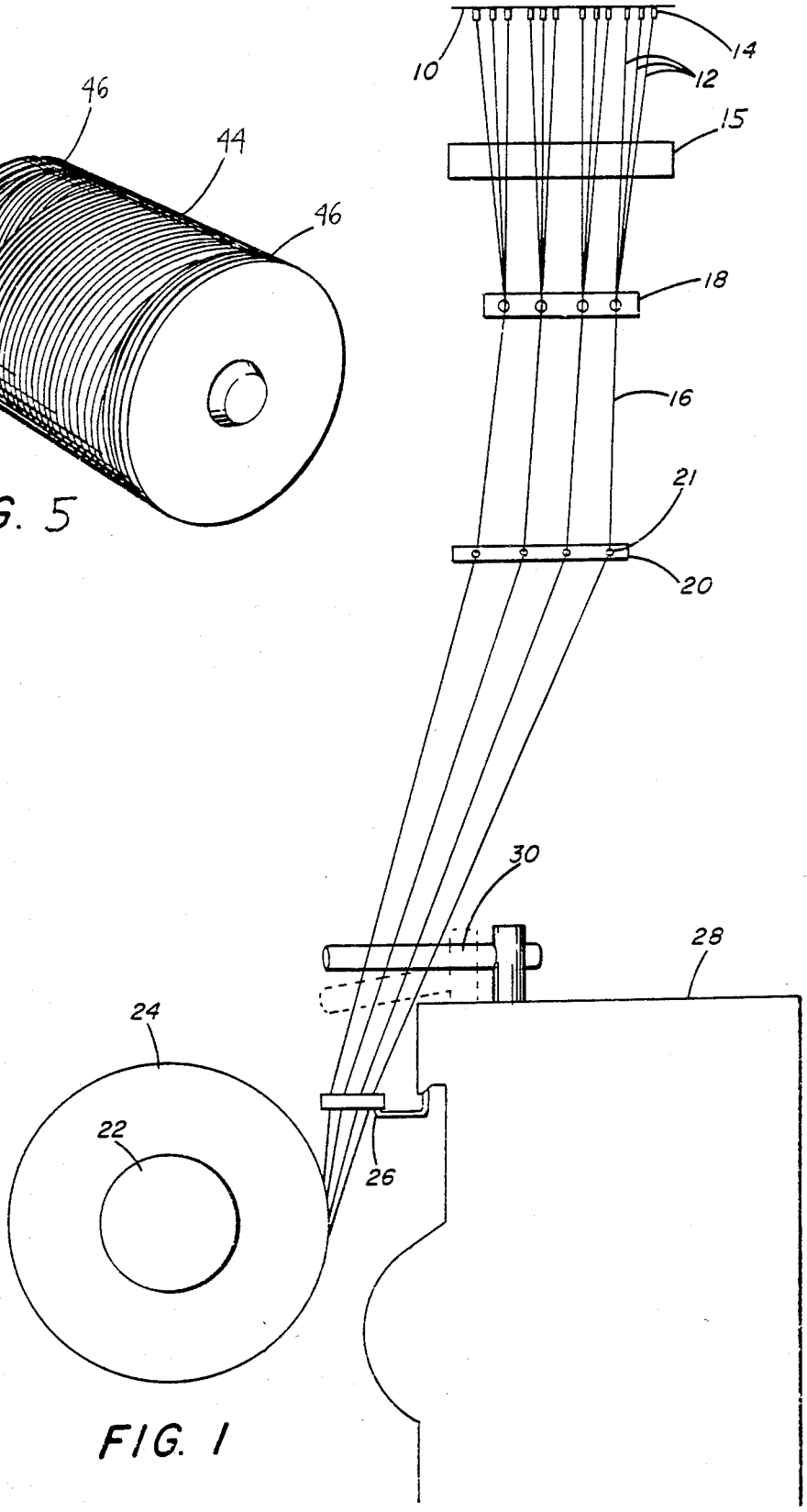
FIG. 1 is a view taken from the front of an apparatus for forming and winding a plurality of continuous strands into an essentially cylindrical package having successive layers of the plurality of continuous strands.

Referring initially to FIG. 1, there is illustrated a fiber forming apparatus generally designated as numeral 10, and referred to as a bushing, from which glass fibers, numeral 12, are drawn or attenuated from cones of heat softened glass tips, 14, in the openings of the bottom of the bushing 10. The bushing may, for example, have 40 pairs of rows with 25 tips in each pair of rows so that about 2,000 fibers can be simultaneously drawn from the tips in the bushing 10. From each of the pairs of rows around 50 to 1,000 fibers, 12 are gathered and formed into more than one strands each designated by numeral 16. These strands, 16, are formed by gathering the fibers 12 in gathering shoe 18. The gathering shoe can be any device known to those skilled in the art for gathering fibers into strands, a nonexclusive example of which is a rotatable gathering shoe which is usually made of graphite. Another nonexclusive example is a stationary shoe or comb, which can be made of graphite or cotton and phenolic resin laminate such as micarta or reinforced phenolic laminates. Before the fibers, 16 are gathered into one or more strands, 16, the fibers, 12, are passed in contact with an applicating device to supply the fibers with a coating of chemical material over a substantial portion of their surfaces. The coating usually has a carrier such as water and may have a coupling agent or a binder solution having a film former. In addition the coating can have lubricants, surfactants, emulsifiers and the like known to those skilled in the art. The applicating device which is illustrated in FIG. 1 as numeral 15 can be any applicator known to those skilled in the art.

Although FIG. 1 indicates that these strands, 16, hereinafter referred to as strands, can be formed from the illustrated number of fibers, 12, the present invention is not restricted to operation with three strands, 16, but can be useful with more than one strand or a greater number of strands, for example, 6–10 strands or even more with the same number of slots in the traversing guide as the number of strands. The number of strands, 16, generally varies from 2 to more than 12.

The strands, 16, from the gathering or splitting device 18 travel downwardly. In a double level operation, the strands travel along divergent paths established by a bar 20, which has a plurality of guides 21 to accommodate the number of strands so as to direct the strands, 16, further downward to converge at the winder after passing through a slotted traversing device 26 for disposition onto a rotating winder, mandrel or collet 22. Bar 20 is needed in a double level operation because the glass fibers, 12, travel a distance from the bushing to the point of being wound as strands, 16, onto a package which is a distance of two operating floors. In the double level operation, the distance between the bushing nozzles and the axis of the winder is generally around 3.5 to 4 meters. Bar 20 separates the strands, 16, from each other a sufficient distance so that when the strands, 16, pass through the slotted traversing device the converging paths of the strands, 16, still allow for some separation at the slotted traversing device. In a single level operation, where the distance between the nozzles of the bushing and the axis of the winder is around 2 to about 2.5 meters, the bar 20 is not necessary because the converging paths of travel of the strands, 16, naturally allows for such a separation of the strands, 16, at the slotted traversing device. In the double level operation, if the strands, 16, are not adequately separated from each other at the traversing guide 26, the holes or hooks 21 in bar 20 are separated further from each other to cause the strands, 16, to diverge to a greater extent. This further divergence of strands, 16, increases the length of the point of convergence downwardly away from bar 20, and permits an increase in the separation of the strands, 16, at the traversing guide 26. If less separation of the strands, 16, at the traversing guide 26 is desired, the holes or hooks 21 that contain the strands, 16, are moved closer to each other. Generally, the strands on either end of bar 20 can be moved outwardly from the center of the bar to a distance, where the angle formed in the strands, 16, between the ingressing strand segment and the egressing strand segment can be up to around 90°.

As the strands, 16, travel downwardly in converging paths to winder 22, which provides the force of attenuation for the fibers, 12, from bushing 10 and which also winds the strand, 16, into a package 24, the strands, 16, are guided in traversing manner by slotted traversing guide 26. The traversing guide is movably attached to reciprocating means 28, which may be any reciprocating mean known to those skilled in the art with a conventional drive means and means for translating rotational motion into linear reciprocating motion, for example, like that disclosed in U.S. Pat. No. 3,998,404 (Reese), hereby incorporated by reference. The operation of the reciprocating means 28 causes the traversing guide 26 to move the converging strands, 16, back and forth in a linear direction parallel to the axis of rotation of the winder so that the strands, 16, are deposited on the winder to form a layer across the peripheral surface of the winder. As the traversing guide comes to the end of each stroke and the reciprocating means reverses, the strands hit contact means 30 shown in FIG. 2 or a contact means located at the opposite end of the stroke not shown in FIG. 1 but shown in FIG. 2. In this reciprocating traversing movement, a stroke is a single traverse before the traversing guide reverses for a traverse in the opposite direction.

The winder and reciprocating means generally interact so that one or both move away from each other as the layers of strands build up on the winder. This movement precludes any substantial contact between the traversing guide 26 and the outer layer of package 24. Any conventional mechanism known to those skilled in the art for effecting this movement can be used. For example, the mechanism in the reciprocating device of U.S. Pat. No. 3,998,404, hereby incorporated by reference, may be used or a movable winder and reciprocating means used in conjunction with an air sensing device like that of U.S. Pat. No. 4,244,533, hereby incorporated by reference, may be utilized. Also a spring sensing mechanism associated with the traversing guide and reciprocating means as known by those skilled in the art may be used to move the traversing guide and the reciprocating means away from the rotating winder.

Figure 2:
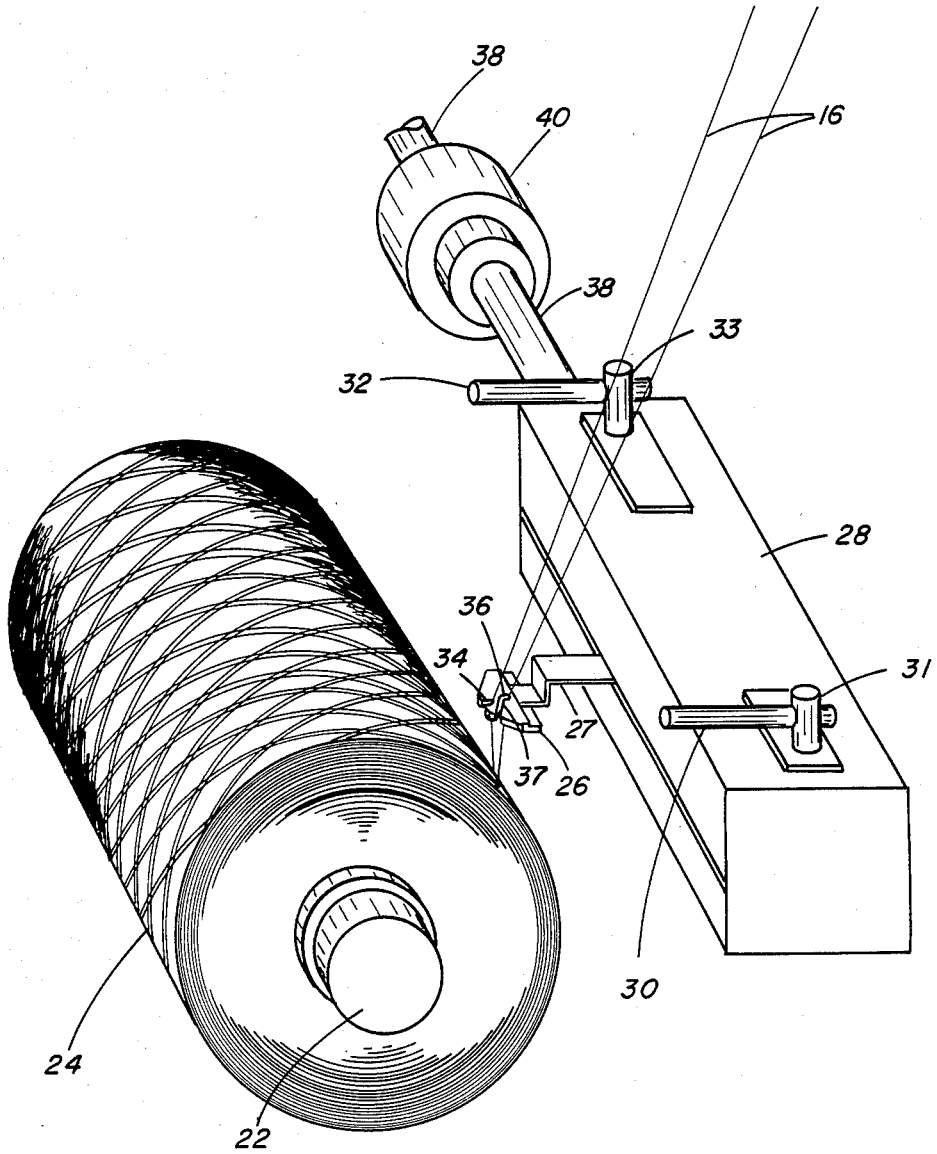
FIG. 2 is an enlarged isometric view of the winder, reciprocating means and slotted traversing guide and contacting means shown in FIG. 1.
Figure 3:
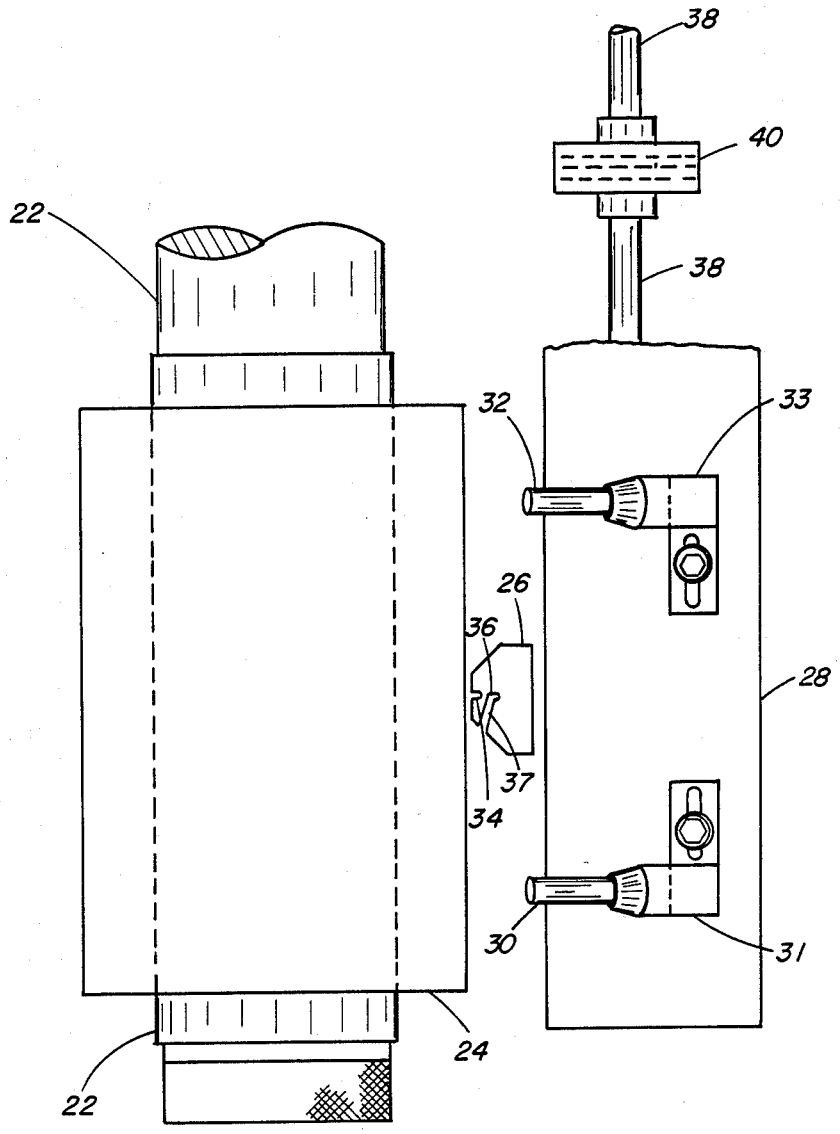
FIG. 3 is a plan view of the winder, slotted traversing guide, reciprocating means and impingement means shown in FIG. 1.

Turning now to FIGS. 2 and 3, there is shown in FIG. 2 an isometric view and in FIG. 3 a plan view of winder 22, package 24, traversing guide 26, reciprocating means 28 and contact means 30 and 32. The reciprocating means 28 holds the traversing guide 26 through tongue 27 in a near horizontal position and preferably a horizontal position so that the plurality of strands, 16, 16 can approach the traversing guide from a direction varying from an acute angle up to a perpendicular angle in relation to the guide. Generally, the geometry of the downwardly traveling filaments and strands, 16, in relation to the winder can be any geometry known to those skilled in the art. The fiber forming means, applicating means, gathering means, traversing guide, reciprocating means, and winder along with the diverter means, if used, are all positioned and supported in relation to each other to obtain the proper filament and strand geometry. For example, the winder can be directly under the bushing or not directly under the bushing, but off to one side including in front of or behind the downward projections of the perimeter of the bushing.

As shown in FIG. 2, the slotted traversing guide with two slots for traversing two strands, 16, in a near horizontal position to the tongue 27 of reciprocating means 28 is reciprocated parallel to the axis of rotation of winder 22. The reciprocating means 28 as shown in FIG. 2 is stationary so that the winder 22 is adapted to movement away from the reciprocating means 28, as the package 24 is built up on winder 22. The reciprocating means 28, as mentioned above, can be like that of U.S. Pat. No. 3,998,404 used in conjunction with the air sensing device of U.S. Pat. No. 4,244,533 (not shown). The tongue 27 is connected through appropriate attachments to rotating shaft 38 so that the circular motion of shaft 38 is converted into the linear reciprocating movement of tongue 27.

On top of reciprocating means 28 are located attachment means 31 and 33 that support contact means 30 and 32 respectively. These contact means can be positioned anywhere on the reciprocating means or a separate support means so that the contact means are above or below the reciprocating slotted traversing guide so that the traversing guide can pass under or over one contact means at each end of the traverse of the guide. Preferably, the contact means are located above the reciprocating slotted traversing guide and perpendicular to the axis of rotation of the winder. As is more clearly shown in FIG. 3, the contact means 30 and 32 are located at a position preferably somewhat short of the end regions of the package 24, and they are movable so that, if desired, they can be located intentionally at some other specific distance at or short of the end regions of the package 24. The additional distance travelled by the slotted guide results in bending the strands at the contact means. This bending effects an increase in tension on the strands, 16, which assists in depositing the strands, 16, in a specific peripheral line on the winder at each end of the traversing stroke for successive traversing strokes. When the contact means are located below the slotted traversing guide, the contact means can be at the end of the layer to be deposited on the winder but short of the full traverse of the slotted traversing guide or of the point of reversal of the traversing guide. When the contact means are located above the slotted traversing guide, the contact means are located short of the point of reversal of the slotted traversing guide and the end regions of the package. The location of the contact means at a specific distance somewhat short of the position directly across from the ends of package 24 will be dictated by the type of strands being wound onto the winder. Generally, when the strands, 16, are tacky, the contact means 30 and 32 should be at a position about 0.1 to around 3 inches short of the position across from the edges or end regions of package 24, and about 0.1 inch to around 3 inches short of the point of reversal by the traversing guide. Less tacky or nontacky strands, 16, will require the contact means to be at a position further inboard than around 3 inches from the edges of the package.

The contact means can be constructed of any material capable of contacting filamentary material without damaging the filamentary material and without excessive wear of the contacting material. The traversing guide can be constructed of any suitable material. Particularly useful materials for both the contact means and traversing guide are glass fiber reinforced resins such as polypropylene, nylon, polyester resins, epoxy resins, polycarbonates and the like, hard rubber, micarta, sheet material such as steel, brass, as well as graphite.

The traversing guide 26 can be located at some distance from winder 22 but the guide is always slightly elevated from the point of contact between the strands and the winder. The distance of the guide away from the winder and the surface of the package being built during winding is that distance which will not result in the guide excessively rubbing the peripheral layer of the completed package, and preferably in the range of about 2 mm to about 20 mm or more. As is shown in FIGS. 2 and 3, the traversing guide has two slots 34 and 36, where the second slot 36 is positioned directly behind slot 34 in a linear line perpendicular to the axis of rotation of the winder 22. The guide can be formed of a single piece of material having the slots formed by molding or stamping techniques. If desired, the guide can be multi-layered material. The guide 26 can have a flat body or a nonflat body, where the shape of the guide is any shape suitable to permit slots to be formed in the guide and to permit attachment to a reciprocating means. Nonexclusive examples of such shapes include polygonal such as pentagonal and hexagonal as well as triangular, rectangular, circular, semicircular, eliptical, semi-eliptical and the like. The two slots on the traversing guide shown in FIGS. 2 and 3 are adapted so that one strand, 16, can be placed in each slot. The slots extend into the body of the guide and terminate with an interior curved end, where the slot with the curved end has a sufficient depth into the body of the guide to retain the strand, 16, that is placed there during the traversing of the guide in a reciprocating fashion. The slots open to any peripheral surface of the guide directly as is shown for slot 34 in FIGS. 2 and 3 or through a chamber such as chamber 37 for slot 36. Chamber 37 associates with slot 36 to enable slot 36 to be directly behind slot 34. The size and location of chamber 37 is that which is sufficient to allow placement of one strand, 16, into slot 36 and have the strand, 16, retained by slot 36 during the reciprocating traversing movement of the guide.

Also shown in FIGS. 2 and 3 is engaging means 40 which controls the starting and stopping action for the traversing guide 26 to start depositing successive layers on a rotating winder or to stop after a package of successively wound layers of strands is completed and a new package is to be started. In FIGS. 2 and 3 the engaging means 40 is located on reciprocating drive means 38. The drive means can be any drive means known to those skilled in the art for effecting rotation of the reciprocating means which with proper cam linkages translated the rotational motion to a linear reciprocating motion of the tongue 27. For example, the drive means can be a belt and pulley assembly to transfer a rotational drive force from the drive means for the winder. With such an assembly, the engaging means can be a mechanical or electromechanical clutch such as an eddy-current clutch 40. The clutch is attached to the drive shaft 38 and magnetic forces within the clutch transfer torque from drive shaft 38 entering the clutch to the draft shaft 38 leaving the clutch. In practice, it is preferred that the drive means is the assembly of belts and pulleys from the motor that is the drive means to rotate the winder. Such a motor can be an induction motor with or without a variable speed drive. In operation, the speed of the motor remains constant and drives shaft 38 to clutch 40 and changes of the flux density (magnetic forces) within the clutch vary the amount of the motor's constant speed rotational energy output that is transferred to the drive shaft 38 leaving the clutch. The greater the flux density, the larger is the percentage of motor output transferred to the output drive shaft 38. The flux density is controlled through electrical coils which have electrical attachments to a switch which can be used to engage and disengage the clutch to cause the output drive means 38 to start or stop, thereby starting or stopping tongue 27 and traversing guide 26. Examples of electromagnetic clutches that can be used include those available from Warner Electric Company. Alternatively, the engaging means could be an independent DC or AC motor for the reciprocator 28 to drive shaft 38 where the motor is controlled by an on and off electrical switch. In this case, engaging means 40 would be the independent motor and a clutch would not be needed. With the motor switched on, the shaft 38 and tongue 27 would be driven to cause the guide 26 to start, and with the motor switched off the guide would stop. Also, any other engaging means could be employed at some other point along the reciprocating means, drive arrangement or motion transferring arrangement to disengage the guide 26 to cause the guide to start and stop the reciprocating traversing movement separately from the starting and stopping of the rotation of the winder.

In utilizing the apparatus of the present invention and in conjunction with the operation in which continuous filaments, 12, are gathered into two or more strands that are wound into a multi-strand package, the invention is utilized in the following manner. The continuous filaments, 12, are supplied from orifices in a bushing, where the filaments, 12, are attenuated by a winder. As the filaments are removed from the orifices and have cooled sufficiently, a chemical treating composition is applied to them and they are gathered into two or more strands, 16, performed by any conventional method of using two or more gathering shoes. The two or more strands, 16, are then wound onto the end of the winder. At this time, the electromagnetic clutch or the engaging means is disengaged from the drive means 38 so that the traversing cam within reciprocating means 28 and tongue 27 and guide 26 are stationary. The two or more strands, 16, wound on the edge of the winder are led onto a forming tube, which is also on the winder and the two or more strands are separated and each strand is placed into one slot of the strand guide 26. After the two or more strands are placed in the strand guide, the electromagnetic clutch or engaging means is energized by a switch to engage the drive shaft 38 to link the traverse cam and the traverse drive shaft within reciprocating means 28 to cause the strand guide 26 to move in a reciprocating traversing manner. The contacting means 30 and 32 are adjusted perpendicular to the axis of rotation of the winder to induce additional tension to the two or more strands at each end of the layer of strands being placed on the winder. The additional tension stops the strands, 16, from looping and stops the loss of one or more of the splits at the reversal of the strand guide 26 when the strand guide 26 reverses and starts traversing in the opposite direction. The position of the contacting means is dependent upon the characteristics of the winder being utilized, the strand tension desired, the chemical composition present in and on the strands and the like. After successive layers of the two or more strands have been accummulated and the package is completed, the winder is deenergized but preferably, the electromagnetic clutch or engaging means 40 remains energized so that the reciprocating means is still engaged during the deceleration time of the winder. This facilitates outside end finding of the package. The completed package is removed from the winder and, by a switch, the electromagnetic clutch or engaging means 40 is disengaged to stop the traversing guide so that another package can be started. Both the winder and reciprocating means can have braking devices to provide for a desired deceleration of the winder and/or reciprocating means.

Figure 4:
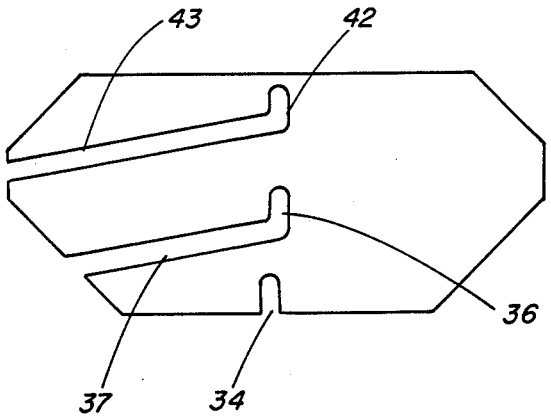
FIG. 4 is a plan view of the slotted traversing guide useful in the instant invention for disposition of strands onto a winder.

FIG. 4 shows an alternative embodiment for the traversing guide 26 having three slots 34, 36 and 42. The slots have a terminal portion which has a curved end which is aligned linearly directly behind the terminal portion of the preceeding slot. FIG. 4 indicates that slot 34, the first slot, is just the terminal portion of the slot whereas slots 36 and 42 have chambers 37 and 43, respectively. The chambers allow the terminal portion of the slot to communicate with the peripheral edge of the traversing guide. The chambers are utilized for placing the strands into the terminal portion of the slot. The slots must have this opening to the peripheral edge of the traversing guide to allow for the placement of the strands in the slots. The curved end terminal portion of each slot has sufficient depth to retain the strand placed in the slot during the reciprocating traversing motion of the traversing guide 26. The distance between the terminal portions of the slots behind each other will vary depending on how far the slotted traversing guide is from the winder, but generally the distance between the slots can be in the range of about 0.06 inch to about 0.5 inch (1.5 mm to 13 mm). Greater distances would not lead to any added benefits since a larger dimensioned guide would have to be used. The large guide would necessitate the use of large drive means to reciprocate a larger mass. The opening of the entry chamber into the terminal portion of the slot can be from any peripheral edge of the traversing guide and is not restricted to one side as is shown in FIG. 4, but the chambers should not open to the back peripheral edge of the guide that faces the reciprocator. If more slots are desired, the traversing guide can be made larger than the dimensions of the flat bodied guide shown in FIG. 4. The mass of traversing guide should be kept to a minimum in order to utilize smaller motors for driving the reciprocating means and the traversing guide. The heavier the mass of the guide, the more powerful the motor necessary to move it. It is preferred that the slots in the guide range from about 2 to about 10. The thickness of the guide can be any suitable thickness and generally is in the range of about 0.1 inch to about 0.5 inch (0.3 cm to 1.3 cm). The completed multiple strand package can be used or shipped in the condition at which it was produced with a moisture content of around 1 to 15 weight percent, or the package can be dried at conventional drying conditions in known drying devices.

PREFERRED EMBODIMENT OF THE INVENTION

In the preferred embodiment of the apparatus of the present invention, the traversing guide has two slots as is shown in FIGS. 2 and 3 and the traversing guide is made of micarta while the contact means is made of graphite rods. These graphite rods are preferably located about 3 inches from each end of the package to be built. The traversing guide passes under the graphite rods and traverses an additional three inches or more before the reversing to traverse in the opposite direction. The preferred engaging means is an electromagnetic clutch and the operation of the apparatus preferably is that as described for the operation of the apparatus of FIGS. 2 and 3 using the two strands.

Figure 5:
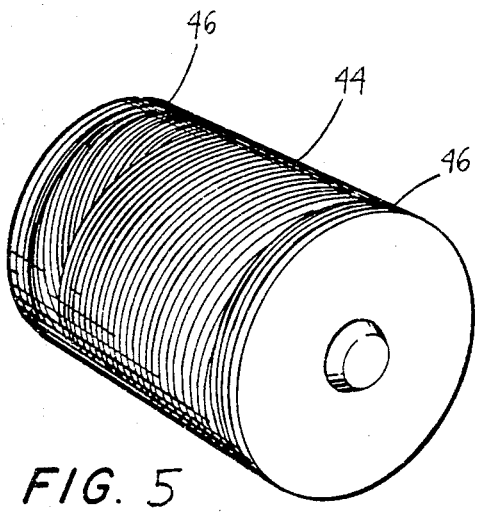
FIG. 5 is a perspective view of a wound package produced in accordance with the present invention.

The package produced in accordance with the aforedescribed method is a "waywound" package, wherein the multiple strands are wound in some crossing relationship to the multiple strands in successive layers because of the traversing action of the guide. In each layer the more than one strand tends to cross at various points in the layer. At the ends of the layers, the added tension on the strand caused by the contacting means results in straighter squarer edges in the package of successive layers. The package preferably has a moisture content present from the treatment with the chemical composition and this moisture content varies between about 1 to 10 weight percent of the package, and most preferably from about 6 to about 10 weight percent. A view of the package is shown in FIG. 5, where the multiple strands in the center portion of a layer 44, are in both crossing and noncrossing relation to each other, and where the multiple strands at the ends of each layer and the ends of the package 46 form nearly square ends.

While the invention has been described with reference to certain specific examples and illustrative embodiments, it is not intended to be limited thereby except insofar as appears in the accompanying claims.

I claim:

1. An apparatus for producing and collecting a plurality of strands, comprising:

a. a means for forming a plurality of continuous fibers from a supported supply, b. applicating means mounted beneath the supply means to treat the continuous fibers with a chemical composition, c. gathering means mounted beneath the applicating means to gather the plurality of fibers from the forming means into more than one strand, d. a rotatable winder to attenuate the continuous fibers and to collect the more than one strand, e. a traversing guide having more than one slot, the slots are located linearly with one behind the previous slot after the first slot, where the linear slots are perpendicular to the axis of rotation of the winder and where each slot receives one strand, and where the slots extend into the guide and terminate with a curved end with sufficient depth to retain the strands during traversing and where the slots behind the first slot open to the peripheral surface of the guide through chambers that are arranged so the strands remain in the slots at the end of the chambers during traversing of the guide, f. reciprocating means to which the traversing guide is nearly horizontally attached for reciprocation parallel to the axis of rotation of the rotating winder, g. engaging means to engage the reciprocating means to start the traversing movement of the traversing guide and to disengage the reciprocating means to stop the traversing movement of the guide, h. a drive means to effect the reciprocating movement of the traversing guide when engaged through the engaging means to the reciprocating means, i. an adjustable contact means around each end of the reciprocating stroke of the traversing guide positioned so that the traversing guide passage by the contact means around the end of each stroke so that strands passing to or from the traversing guide are contacted by the contact means to apply tension to the strands being wound on the winder.

2. Apparatus of claim 1, wherein the engaging means is a clutch to engage and disengage the reciprocating means.

3. Apparatus of claim 1, which includes a diverter bar positioned after the means for gathering the fibers and before the winder and traversing guide to cause the strands to separate a sufficient distance from each other so that the strands are separated as they pass through the traversing guide and converge at the point where they contact the winder.

4. Apparatus of claim 1, which includes a movable support means to which the reciprocating means is attached and through which the reciprocating means drives the traversing guide.

5. Apparatus of claim 2, wherein the clutch of the engaging means is an electromagnetic clutch which engages and disengages the reciprocating means by means of an electric switch.

6. Apparatus of claim 1, wherein the forming means is a bushing for forming glass fibers from a supply of heat softened, fiberizable glass.

7. Apparatus of claim 1, wherein the gathering means gathers the fibers into a number of strands which correspond to the number of slots in the traversing guide.

8. Apparatus of claim 1, wherein the traversing guide has a generally flat body.

9. Apparatus of claim 1, wherein the contact means is located from about 0.1 inch to about 3 inches (about 2.54 mm to about 76 mm) from the point where the traversing guide reverses to traverse in the opposite direction.

10. Apparatus of claim 1, wherein the traversing guide has a octagonal shape.

11. Apparatus of claim 1, wherein the distance between the terminal portions of the slots is in the range of about 0.06 inch to about 0.5 inch.

12. Apparatus of claim 1, wherein the contacting means are located a distance of about 0.1 inch up to around 3 inches from the point where the traversing guide reverses direction to traverse in the opposite direction which point is across from the ends of the layer of strands.

* * * * *

UNITED STATES PATENT AND TRADEMARK OFFICE

CERTIFICATE OF CORRECTION

PATENT NO. : 4,509,702

DATED : April 9, 1985

INVENTOR(S) : Walter J. Reese

It is certified that error appears in the above-identified patent and that said Letters Patent is hereby corrected as shown below:

Column 12, line 65, before "the" insert --where--.

Column 13, line 23, delete "passage" and insert --passes--.

Signed and Sealed this

*Ninth* Day of *July 1985*

[SEAL]

*Attest:*

DONALD J. QUIGG

*Attesting Officer* *Acting Commissioner of Patents and Trademarks*